US008823476B2

(12) United States Patent
Harrison

(10) Patent No.: US 8,823,476 B2
(45) Date of Patent: Sep. 2, 2014

(54) SUPERCONDUCTING MAGNET APPARATUS AND CONTROL METHOD THEREOF

(71) Applicant: Samsung Electronics Co., Ltd., Suwon-si (KR)

(72) Inventor: Stephen M. Harrison, Wallingford (GB)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/649,492

(22) Filed: Oct. 11, 2012

(65) Prior Publication Data

US 2013/0088313 A1 Apr. 11, 2013

(30) Foreign Application Priority Data

Oct. 11, 2011 (KR) ..... 10-2011-0103792

(51) Int. Cl.
*H01F 1/00* (2006.01)
*H01F 6/00* (2006.01)
*H01F 6/02* (2006.01)

(52) U.S. Cl.
CPC .. *H01F 6/00* (2013.01); *H01F 6/02* (2013.01); *H01F 6/008* (2013.01)
USPC ..... 335/216; 335/295

(58) Field of Classification Search
CPC ..... H01F 6/00; H01F 6/02; H01F 6/008; H01F 2006/00; H01F 2006/001; H01F 27/40; H01F 6/065
USPC ..... 335/216, 296–299; 74/125.1; 200/83 R, 200/83 C, 83 D, 250
See application file for complete search history.

(56) References Cited

U.S. PATENT DOCUMENTS

| | | | | | |
|---|---|---|---|---|---|
| 4,021,633 | A * | 5/1977 | Kuwabara et al. | ..... | 200/262 |
| 4,024,363 | A * | 5/1977 | Marsing et al. | ..... | 200/83 R |
| 4,623,769 | A * | 11/1986 | Franksen | ..... | 200/250 |
| 7,132,914 | B2 * | 11/2006 | Nemoto et al. | ..... | 335/216 |
| 2006/0279387 | A1 * | 12/2006 | Nemoto et al. | ..... | 335/216 |

FOREIGN PATENT DOCUMENTS

| | | | |
|---|---|---|---|
| JP | 9-134653 | A | 5/1997 |
| KR | 1994-0000050 | Y1 | 1/1994 |
| KR | 10-2005-0105276 | A | 11/2005 |
| KR | 10-2006-0088351 | A | 8/2006 |
| KR | 10-2010-0136794 | A | 12/2010 |

OTHER PUBLICATIONS

International Search Report (PCT/ISA/210), dated Mar. 8, 2013, issued by the International Searching Authority in counterpart International Patent Application No. PCT/KR2012/008122.
Communication dated Aug. 1, 2013 from the Korean Intellectual Property Office in a counterpart application No. 10-2011-0103792.

* cited by examiner

*Primary Examiner* — Bernard Rojas
(74) *Attorney, Agent, or Firm* — Sughrue Mion, PLLC

(57) ABSTRACT

Provided are a superconducting magnet apparatus with a switch that automatically connects or disconnects an external power source to a superconducting coil, and a method of controlling the same. The superconducting magnet apparatus includes a superconducting coil that generates a magnetic field when an electric current from an external power source is applied thereto, and a switch that supplies or shuts off an electric current output from the external power source by connecting or disconnecting the superconducting coil to the external power source.

21 Claims, 10 Drawing Sheets

SUPERCONDUCTING MAGNET APPARATUS AND CONTROL METHOD THEREOF

CROSS-REFERENCE TO RELATED APPLICATION

This application claims priority from Korean Patent Applications No. 2011-0103792, filed on Oct. 11, 2011 in the Korean Intellectual Property Office, the disclosure of which is incorporated herein by reference in its entirety.

BACKGROUND

1. Field

Apparatuses and methods consistent with exemplary embodiments relate to a superconducting magnet apparatus for generating a magnetic field by receiving an electric current from an external power source, and a control method thereof.

2. Description of the Related Art

With the development in a coil manufacturing technology using a superconducting magnet as well as the advance of relevant devices, such as an insulating container and a refrigerating device, a superconducting magnet apparatus and applications thereof have been developed. The superconducting magnet apparatus includes a superconducting magnet for a superconducting magnet apparatus or a superconducting magnet for a self levitation vehicle. The superconducting magnet apparatus becomes a persistent current state by receiving an electric current from an external power source through a coil that is cooled to a very low temperature. If the superconducting magnet apparatus has become a persistent current state, the output of the external power source is stopped and the superconducting magnet apparatus is driven in a state of being disconnected to the external power source.

The superconducting magnet apparatus requires a current lead when supplying coils with the electric current. The current lead represents a path connecting from a terminal connected to the external power source to a coil existing inside the superconducting magnet apparatus. The current lead is a thermal invasion path along from an ambient temperature terminal, which connects to the external power source, to a very low temperature coil. In a no current state, the current lead becomes an electric heating material. In order to minimize the refrigeration cost of a coil in a superconducting magnet for a superconducting magnet apparatus, the thermal invasion needs to be as small as possible. As a method of reducing the thermal invasion into the superconducting magnet, for a superconducting magnet apparatus operating in a persistent current mode, a demountable current lead is used such that the demountable current lead is separated when a current does not flow, thereby reducing the amount of thermal invasion. However, such a structure of connecting or disconnecting a current lead is handled only by a specialist, and also causes a great workload in a case that an electric current needs to be supplied as an occasion demands.

SUMMARY

One or more exemplary embodiments provide a superconducting magnet apparatus provided with a switch that is configured to automatically connect or disconnect a superconducting coil with respect to an external power source, and a control method thereof.

In accordance with an aspect of an exemplary embodiment, there is provided a superconducting magnet apparatus including a superconducting coil and a switch. The superconducting coil generates a magnetic field by receiving an electric current from an external power source. The switch may selectively connect the external power source to the superconducting coil.

The switch may include a bellows-type switch which is set to an on state and an off state by expansion and contraction of a bellows.

The bellows-type switch may include the bellows which expands or contracts according to an internal pressure, at least one switch which is switched according to the expansion or contraction of the bellows, a gas tank that supplies the bellows with gas, a gas supply pipe which provides a path for the gas supplied from the gas tank to the bellows, and a gas vent pipe which provides a path for the gas discharged from the bellows.

The at least one switch may include a first terminal electrically connected to the external power source and a second terminal electrically connected to the superconducting coil.

If the bellows is expanded, the first terminal electrically connected to the external power source may be connected to the second terminal electrically connected to the superconducting coil If the bellows is contracted, the first terminal electrically connected to the external power source may be disconnected from the second terminal electrically connected to the superconducting coil.

The bellows-type switch may include the bellows that expands or contracts according to an internal pressure, at least one switch that is switched according to the expansion or contraction of the bellows, a gas transfer pipe which supplies an inner side of the bellows with gas or discharge gas from the bellows, a gas tank which stores the gas that is supplied to the bellows or discharged from the bellows, a heater which heats the gas tank and a heat sink which connects to the bellows to dissipate heat.

The heater may be turned on to increase a temperature of the stored gas in the gas tank thereby supplying the gas stored in the gas tank to the bellows, and the heater may be turned off to decrease the temperature of the stored gas in the gas tank thereby discharging the gas in the bellows to the gas tank.

The switch may include a shape memory alloy (SMA)-type switch which is set to an on state and an off state according to a temperature.

The SMA-type switch may include a first connection terminal which connects to the external power, a second connection terminal which connects to the superconducting coil, a shape memory alloy member which couples to one of the first connection terminal and the second connection terminal, and a heater configured to apply heat to the shape memory alloy member.

The shape memory alloy member may remember shapes that correspond to different temperatures.

The shape memory alloy member may be a two-way shape memory alloy member that remembers shapes that correspond to two temperatures, respectively.

If a heat is applied to the shape memory alloy member by the heater, the shape memory alloy member may reach to a predetermined temperature and expands, and if the shape memory alloy expands, the first connection terminal may be connected to the second connection terminal.

If a heat is not applied to the shape memory alloy member by the heater, the temperature of the shape memory alloy member may cool to a room temperature or maintain a room temperature and contract, and if the shape memory alloy contracts, the first connection terminal may disconnect from the second connection terminal or remain disconnected from the second connection terminal.

In accordance with an aspect of another exemplary embodiment, there is provided a method of controlling a superconducting magnet apparatus. The method includes providing a superconducting coil which generates a magnetic field when an electric current from an external power source is applied to. The superconducting magnet apparatus includes a switch that is configured to selectively connect the external power source to the superconducting coil. The method also includes supplying an electric current to the superconducting magnet apparatus from the external power source by switching on the switch, and shutting off the electric current to the superconducting magnet apparatus from the external power source by switching off the switch.

The switch may include a bellows-type switch, an ON/OFF state of which is adjustable by expansion and contraction of a bellows.

The switch may include an SMA-type switch, which is set to an on state and an off state adjustable according to a temperature.

In accordance with an aspect of another exemplary embodiment, a switch which selectively connects an external power source to a superconducting coil of a superconducting magnet apparatus may include a bellows, a first fixed terminal electrically connected to the external power source, a first movable terminal electrically connected to the super conducting coil, a first support member; and a first elastic member, where the first fixed terminal is fixed to the first support member and the first movable terminal is coupled to the first elastic member and moves according to expansion and contraction of the bellows.

The switch may also include a second fixed terminal electrically connected to the external power source, a second movable terminal electrically connected to the super conducting coil, a second support member; and a second elastic member, where the second fixed terminal is fixed to the second support member and the second movable terminal is coupled to the second elastic member and moves according to expansion and contraction of the bellows.

If the bellows of the switch expands, the first movable terminal make a contact with the first fixed terminal and the second movable terminal make a contact with the second fixed terminal. On the other hand, if the bellows of the switch contracts, the first movable terminal disconnects from the first fixed terminal by a tension of the first elastic member and the second movable terminal disconnects from the second fixed terminal by a tension of the second elastic member.

As described above, the supply or the shutdown of an electric current to a superconducting magnet apparatus is controlled by a switch, thereby reducing the workload.

BRIEF DESCRIPTION OF THE DRAWINGS

These and/or other aspects of the disclosure will become apparent and more readily appreciated from the following description of exemplary embodiments, taken in conjunction with the accompanying drawings of which.

DETAILED DESCRIPTION

Figure 1:
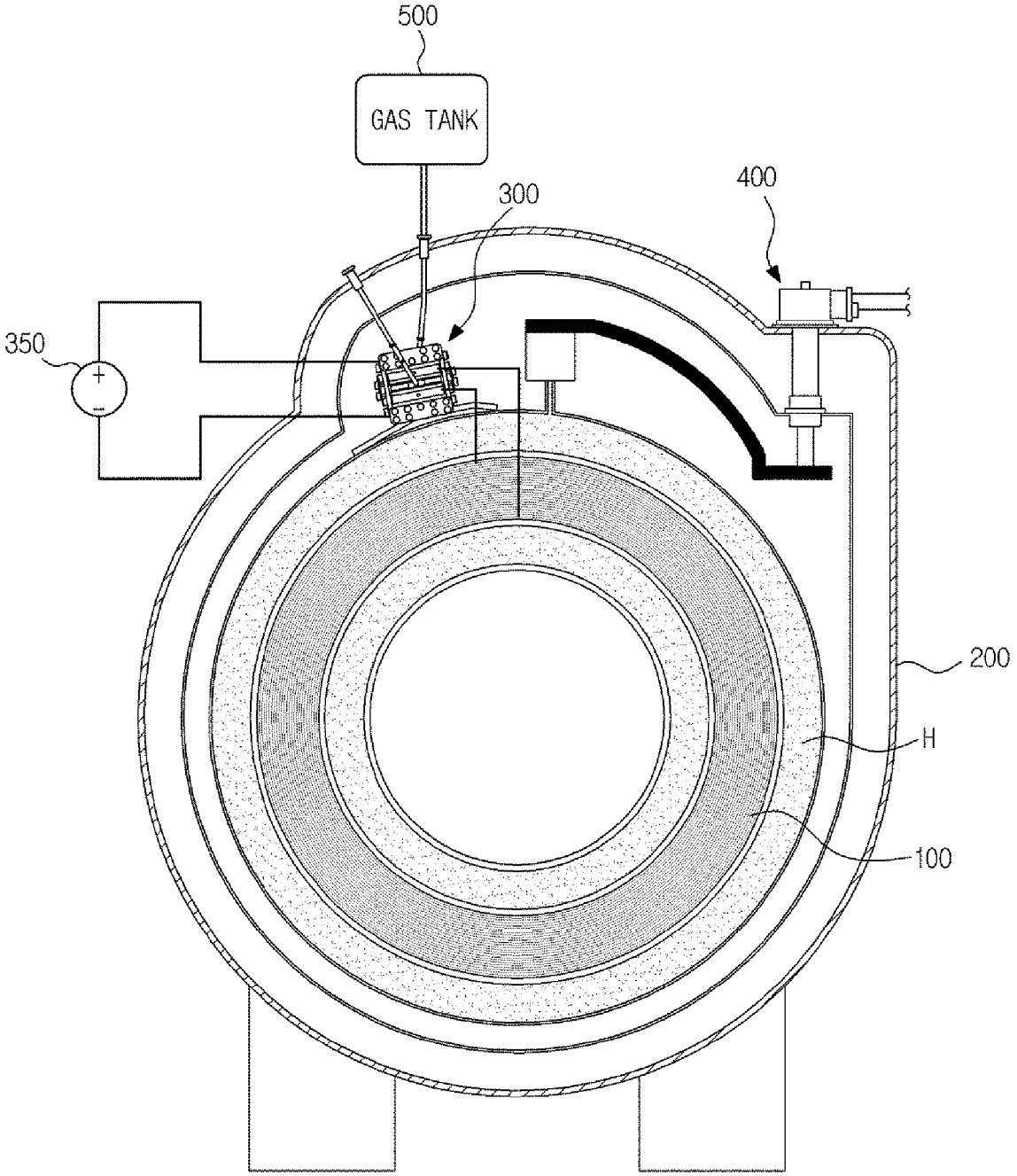
FIG. 1 is a view schematically illustrating a superconducting magnet apparatus according to an exemplary embodiment.

Reference will now be made in detail to the exemplary embodiments of, examples of which are illustrated in the accompanying drawings, wherein like reference numerals refer to like elements throughout.

FIG. 1 is a view schematically illustrating a superconducting magnet apparatus according to an exemplary embodiment.

A superconducting magnet apparatus includes a superconducting coil 100, a housing 200, a switch 300, a cryogenic refrigerating device 400, and a gas tank 500. The superconducting coil 100 operates in a superconducting state while maintaining a cryogenic temperature. The housing 200 is provided in the form of a ring to accommodate the superconducting coil 100. The switch 300 is disposed at one side of the housing 200 to perform a switching operation to connect or disconnect the superconducting coil 100 with respect to an external power source 350. The cryogenic refrigerating device 400 is disposed at one side of the housing 200. The gas tank 500 is configured to supply the switch 300 with gas. Helium (H) in a liquid state is filled in the housing 200 to keep the superconducting coil 100 at a cryogenic temperature.

If the superconducting coil 100 generates heat, the helium in a liquid state filled in the housing 200 undergoes a phase transition into a gas state by absorbing heat. The helium in a gas state has a low density relative to the helium in a liquid state, and moves upward by the difference in density. The helium in a gas state is cooled by the cryogenic refrigerating device 400 disposed at one side of the housing 200, and thus is transformed into a liquid state. In this manner, the superconducting coil 100 disposed in the housing 200 continuously maintains the cryogenic state.

Figure 2:
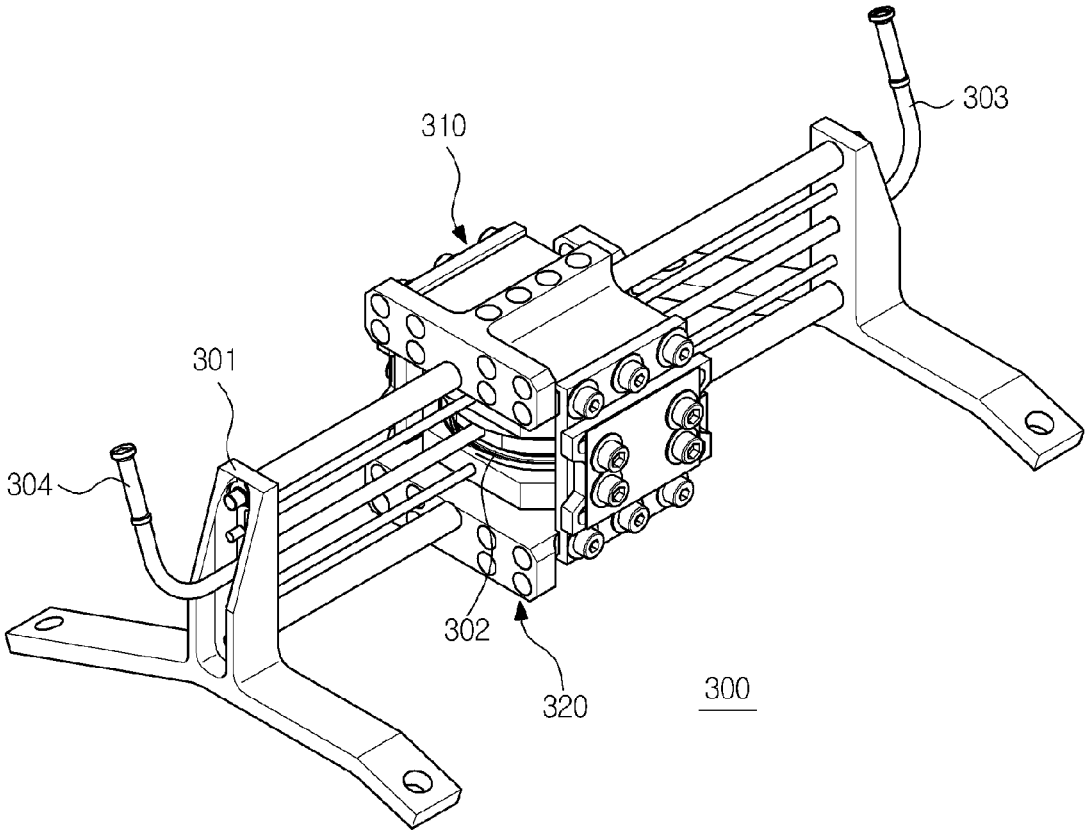
FIG. 2 is a perspective view illustrating a switch provided in the superconducting magnet apparatus according to the exemplary embodiment.
Figure 3:
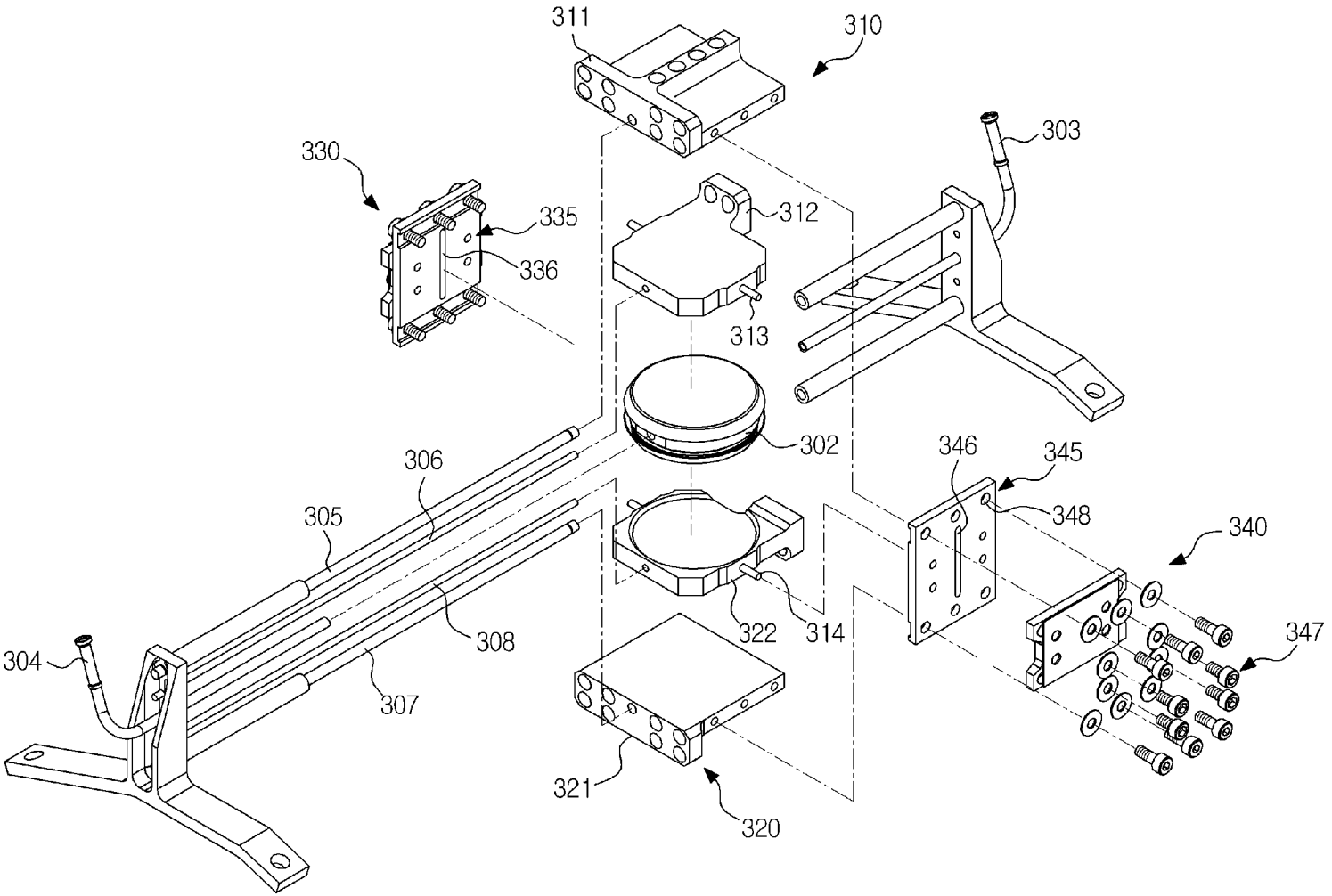
FIG. 3 is an exploded perspective view illustrating the switch provided in the superconducting magnet apparatus according to the exemplary embodiment.
Figure 4:
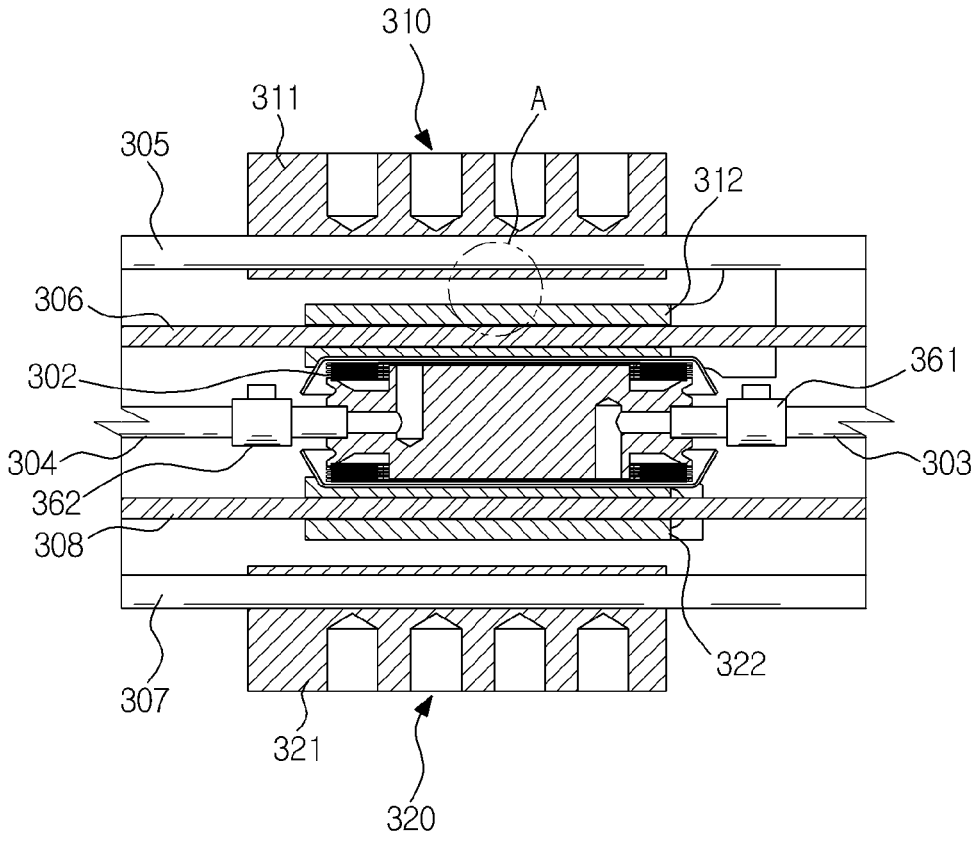
FIG. 4 is a cross-sectional view illustrating the switch in an off-state provided in the superconducting magnet apparatus according to the exemplary embodiment.
Figure 5:
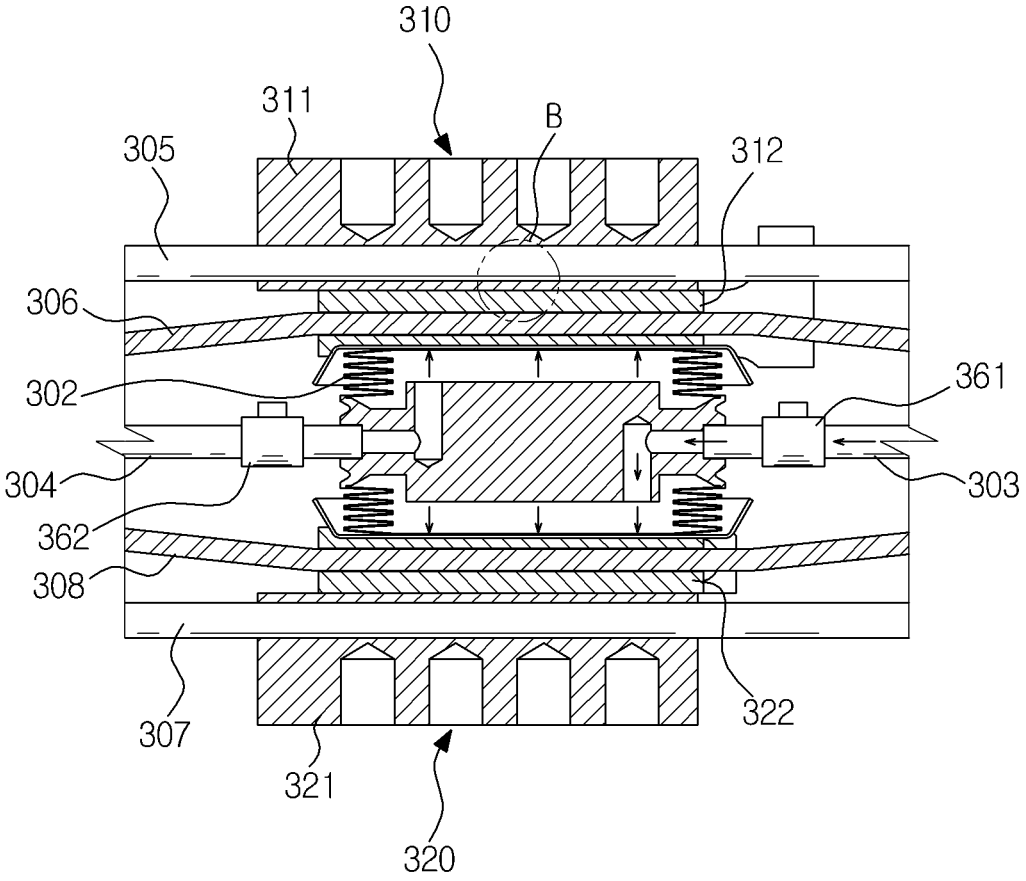
FIG. 5 is a cross-sectional view illustrating the switch in an on-state provided in the superconducting magnet apparatus according to the exemplary embodiment.

FIG. 2 is a perspective view illustrating a switch provided in the superconducting magnet apparatus according to the exemplary embodiment. FIG. 3 is an exploded perspective view illustrating the switch provided in the superconducting magnet apparatus according to the exemplary embodiment. FIG. 4 is a view illustrating a switch in an on-state provided in the superconducting magnet apparatus according to the exemplary embodiment. FIG. 5 is a view illustrating a switch in an off-state provided in the superconducting magnet apparatus according to the exemplary embodiment.

Referring to FIG. 2, the switch 300 is a bellows-type switch 300. The bellows-type switch 300 includes a support bracket 301 fixed to the housing 200, a bellows 302 that expands or contracts according to the internal pressure, a first switch 310 and a second switch 320 that are switched according to the expansion/contraction of the bellows 302, a gas supply pipe 303 to supply the inside the bellows 302 with gas, and a gas vent pipe 304 to discharge the gas that exists in the bellows 302.

Referring to FIG. 3, the first switch 310 provided on the switch 300 includes a fixed terminal 311 fixed to a first support 305 and a first movable terminal 312 that is configured to move according to the expansion or the contraction and is coupled to a first elastic member 306.

The first fixed terminal 311 and the first movable terminal 312 of the first switch 310 are conductors. The first fixed terminal 311 of the first switch 310 is electrically connected to the external power source 350. The first movable terminal 312 of the first switch 310 is electrically connected to the superconducting coil 100. Accordingly, in an on-state of the switch 300, the first movable terminal 312 makes contact with the first fixed terminal 311 to form a current path connecting from the external power source 350 to the superconducting coil 100. In an off-state of the switch 300, the first movable terminal 312 does not make contact with the first fixed terminal 311, and thus shuts off the electric current flowing from the external power source 350 to the superconducting coil 100.

The first movable terminal 312 of the first switch 310 is coupled to the first elastic member 306. The first elastic member 306 has a tension and tends to return to its original state when the bellows 302 is contracted. If the bellows 302 is expanded, the first movable terminal 312 moves and makes contact with the first fixed terminal 311. If the bellows 302 is contracted, the first movable terminal 312 returns to its original state by the tension of the first elastic member 306 and then releases the contact with the first fixed terminal 311.

The second switch 320 provided on the switch 300 includes a second fixed terminal 321 fixed to a second support 307 and a second movable terminal 322 that is configured to move according to the expansion or contraction of the bellows 302 and is coupled to a second elastic member 308.

The second fixed terminal 321 and the second movable terminal 322 of the second switch 320 are conductors. The second fixed terminal 321 of the second switch 320 is electrically connected to the external power source 350. The second movable terminal 322 of the second switch 320 is electrically connected to the superconducting coil 100. Accordingly, in an on-state of the switch 300, the second movable terminal 322 makes contact with the second fixed terminal 321 to form a current path connecting from the external power source 350 to the superconducting coil 100. In an off-state of the switch 300, the second movable terminal 322 does not make contact with the second fixed terminal 321, and thus shuts off the electric current flowing from the external power source 350 to the superconducting coil 100.

The second movable terminal 322 of the second switch 320 is coupled to the second elastic member 308. The second elastic member 308 has a tension and tends to return to its original state when the bellows 302 is contracted. If the bellows 302 is expanded, the second movable terminal 322 moves and makes contact with the second fixed terminal 321. If the bellows 302 is contracted, the second movable terminal 322 returns to its original state by the tension of the second elastic member 308 and then releases the contact with the second fixed terminal 321.

The first switch 310 and the second switch 320 are simultaneously set on or off according to the expansion or the contraction of the bellows 302.

Referring to FIG. 4, the first switch 310 and the second switch 320 are in an off state according to the contraction of the bellows 302. As shown in a region "A" of FIG. 4, a state transition of the first switch 310 and the second switch 320 into an off state represents that the first movable terminal 312 is released from the connection with respect to the first fixed terminal 311 and that the second movable terminal 322 is released from the connection with respect to the second fixed terminal 321.

Referring to FIG. 5, the first switch 310 and the second switch 320 are in an on state according to the expansion of the bellows 302. As shown in a region "B" of FIG. 5, a state transition of the first switch 310 and the second switch 320 into an on state represents that the first movable terminal 312 is connected to the first fixed terminal 311 and that the second movable terminal 322 is connected to the second fixed terminal 321.

The first fixed terminal 311 and the second fixed terminal 321 are primarily fixed to the first support 305 and the second support 307, respectively, and are secondarily fixed to a first fixing member 330 and a second fixing member 340, respectively, to prevent the first fixed terminal 311 and the second fixed terminal 321 from rotating. In addition, the first fixed member 330 and the second fixed member 340 have guide members 335 and 345 fixed thereto. The guide members 335 and 345 are provided at inner sides of the first fixed member 330 and the second fixed member 340. The guide members 335 and 345 are provided with guide slots 336 and 346, respectively, and each provided with a plurality of connecting holes 348 into which a connecting member 347 is inserted.

Guide protrusions 313 and 314 are provided at one side of the first movable terminal 312 and one side of the second movable terminal 322, respectively. The movement of the guide protrusions 313 and 314 are guided along the guide slots 336 and 346 provided in the guide members 335 and 345, respectively.

The bellows 302 is supplied with gas through the gas supply pipe 303. The gas supply pipe 303 is connected to the gas tank 500 to supply gas. A gas valve 361 is installed inside the gas supply pipe 303. According to the on/off state of the gas valve 361, the gas stored in the tank 500 is supplied to the bellows 302 through the gas supply pipe 303 or blocked from being supplied to the bellows 302 through the gas supply pipe 303.

The gas that exists in the bellows 302 is discharged through the gas vent pipe 304. A gas valve 362 is installed on the gas vent pipe 304. According to the operation of the gas valve 362, the gas supplied to the bellows 302 is discharged or blocked from being discharged. Meanwhile, the on/off state of the gas vales 361 and 362 is adjusted according to the operation by an actuator (not shown).

Figure 6:
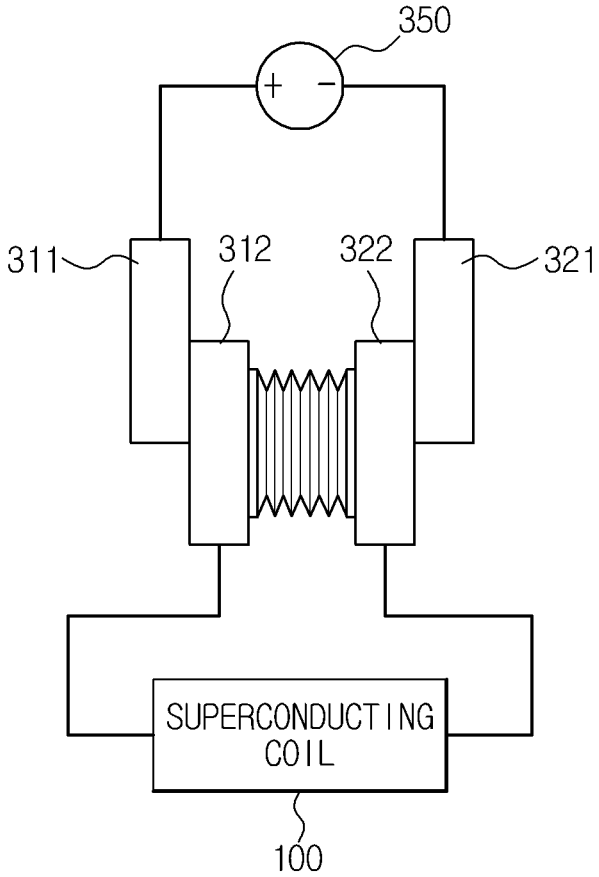
FIGS. 6 and 7 are views illustrating a concept of operation of the switch provided in the superconducting magnet apparatus according to the exemplary embodiment.
Figure 7:
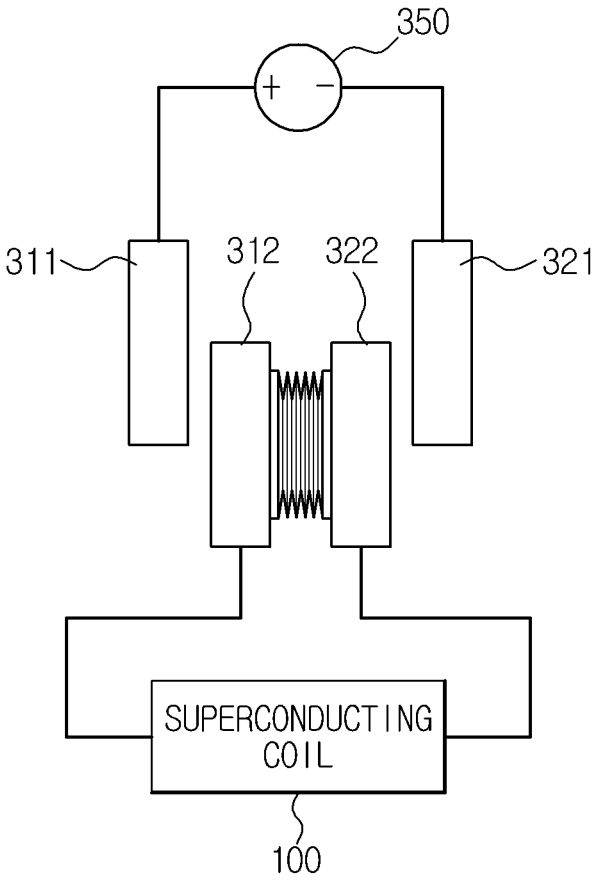

FIGS. 6 and 7 are views illustrating a concept of operation of the switch provided in the superconducting magnet apparatus according to the exemplary embodiment.

Referring to FIG. 6, the first fixed terminal 311 and the second fixed terminal 321 are connected to the external power source 350 while in a fixed state, and the first movable terminal 312 and the second movable terminal 322 are connected to the superconducting coil 100. If the bellows 302 provided between the first movable terminal 312 and the second movable terminal 322 is expanded, the first movable terminal 312 and the second movable terminal 322 are connected to the first fixed terminal 311 and the second fixed terminal 321, respectively. In this case, a current path is formed between the external power source 350 and the superconducting coil 100 to transfer an electric current such that the current output from the external power source 350 is supplied to the superconducting coil 100.

Referring to FIG. 7, if the bellows 302 provided between the first movable terminal 312 and the second movable terminal 322 is contracted, the connection between the first movable terminal 312 and the first fixed terminal 311 and the connection between the second movable terminal 322 and the second fixed terminal 321 are released. In this case, the current path to transfer an electric current between the external power source 350 and the superconducting coil 100 is blocked, thereby unable to output the electric current from the external power source 350.

According to the above described embodiments, the first fixed terminal 311 and the second fixed terminal 321 are connected to the external power source 350, and the first movable terminal 312 and the second movable terminal 322 are connected to the superconducting coil 100. However, according to another exemplary embodiment, the first fixed terminal 311 and the second fixed terminal 321 are connected to the superconducting coil 100, and the first movable terminal 312 and the second movable terminal 322 are connected to the external power source 350.

Figure 8:
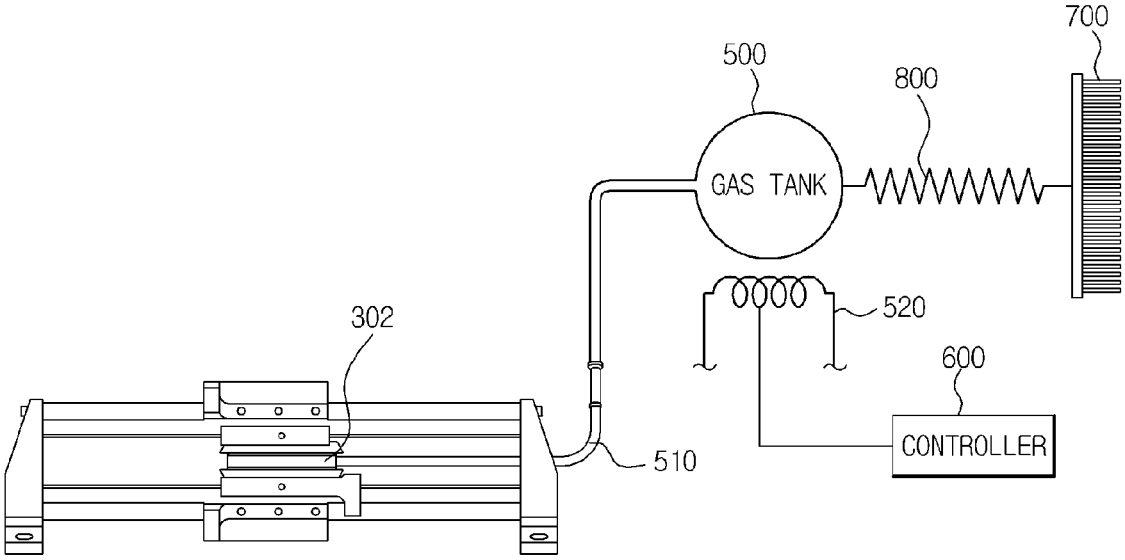
FIG. 8 is a view schematically illustrating a superconducting magnet apparatus according to another exemplary embodiment.

FIG. 8 is a view schematically illustrating a superconducting magnet apparatus according to another exemplary embodiment.

A structure of supplying the bellows 302 with gas is different from the embodiment illustrated on FIG. 2. The embodiment illustrated on FIG. 2 includes the gas supply pipe 303 and the gas vent pipe 304. An electronic valve (not shown) is provided on each of the gas supply pipe 303 and the gas vent pipe 304. According to the on/off of the electronic valve provided on each of the gas supply pipe 303 and the gas vent pipe 304, a control of supplying gas from the gas tank 500 or a control of discharging gas to the bellows 302 is performed.

Referring to FIG. 8, the switch 300 includes the gas tank 500, a gas transfer pipe 510 that is configured to supply the bellows 302 with gas of the gas tank 500 or to discharge the gas of the bellows 302 to the gas tank 500, a heater 520 to increase the kinetic energy of gas in the gas tank 500 by heating the gas tank 500, a controller 600 to control the on/off of the heater 520, a heat sink 700 connected to the gas tank 500 to dissipate heat of the gas tank 500, and a heat transfer member 800 connecting the gas tank 500 to the heat sink 700 to transfer heat.

The controller 600 controls the on/off of the heater 520. When the bellows 302 is expanded to turn the switch 300 in an on-state, the controller 600 turns on the heater 520. Upon turning on the heater 520, heat is transferred to the gas tank 500 so that the kinetic energy of gas is increased by the heat transferred to the gas tank. Upon the increase in the kinetic energy of gas, the gas stored in the gas tank 500 moves to the bellows 302. Upon the supply of gas to the bellows 302, the switch 300 is set to the on-state through the above described mechanism illustrated in FIG. 2.

When the bellows 302 is contracted to turn the switch 300 in an off-state, the controller 600 turns off the heater 520. Upon turning off the heater 520, heat of the gas tank 500 is transferred to the heat sink 700 through the heat transfer member 800, and then dissipated. As the temperature of the gas tank 50 is decreased due to dissipation, the internal gas pressure is lowered. Upon the decrease of the internal gas pressure, the gas stored in the bellows 302 is transferred to the gas tank 500. In this case, the bellows 302 is contracted, and the switch 300 is set to the off-state through the above described mechanism illustrated in FIG. 2.

Figure 9:
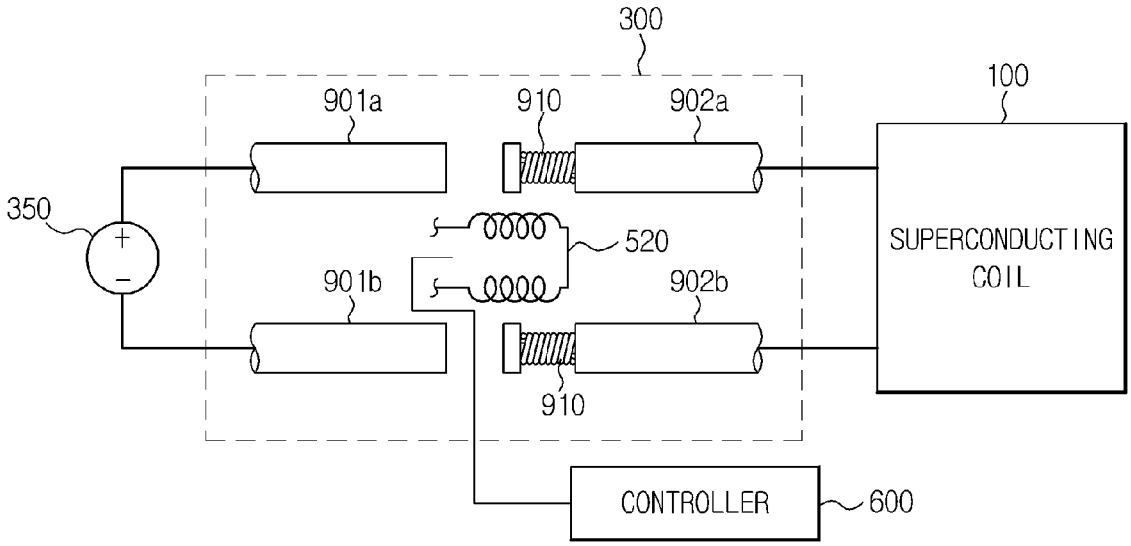
FIGS. 9 and 10 are views illustrating a switch provided in the superconducting magnet apparatus according to another exemplary embodiment.
Figure 10:
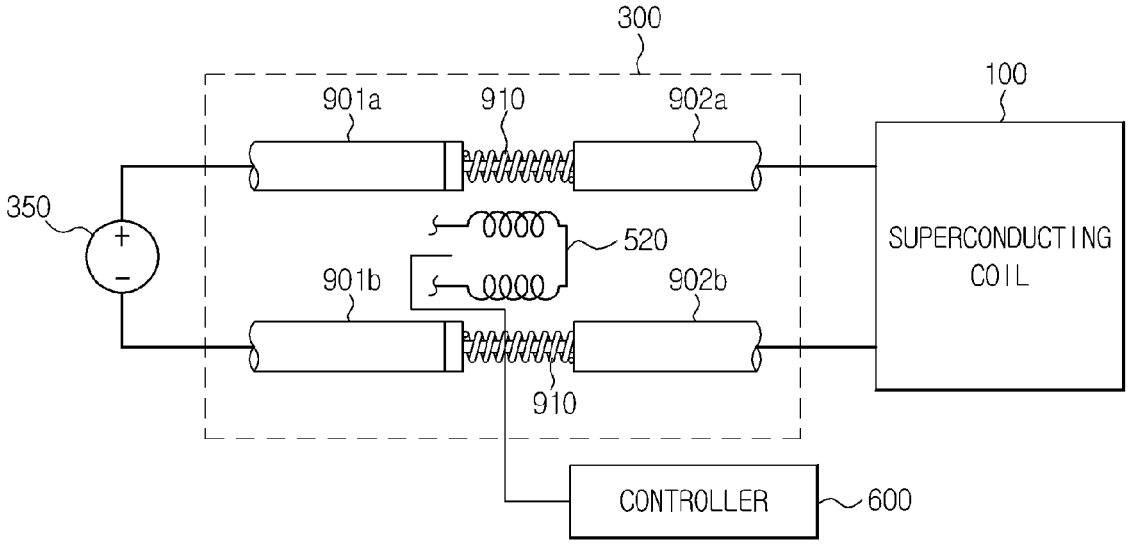

FIGS. 9 and 10 are views illustrating a switch provided in the superconducting magnet apparatus according to another embodiment.

The switch 300 is a shape memory alloy type switch 300, an on/off state of which is adjusted according to the change of temperature. The shape memory alloy type switch 300 includes first connection terminals 901*a* and 901*b* connected to the external power source 350, second connection terminals 902*a* and 902*b* connected to the superconducting coil 100, a shape memory alloy member 910 coupled to the first connection terminals 901*a* and 901*b* or the second connection terminals 902*a* and 902*b* and configured to remember a shape, a heater 520 to apply heat to the shape memory alloy member 910, and a controller 600 to control the on/off of the heater 520. Meanwhile, the shape memory alloy member 910 has a two-way shape memory effect that remembers both a shape at a low temperature and a shape of a high temperature.

When the electric current needs to be transferred to the superconducting coil 100 from the external power source 350, the controller 600 applies heat to the shape memory alloy member 910 by operating the heater 520. If the temperature of the shape memory alloy member 910 increases and reaches to a predetermined temperature, the shape memory alloy member 910 expands, and if the temperature of the shape memory alloy member 910 decreases and reaches to a predetermined temperature, the shape memory alloy member 910 contracts. The shape memory alloy member 910 remembers a shape of the shape memory alloy member 910 when the shape alloy member 910 expands, and a shape of the shape memory alloy member 910 when the shape alloy member 910 contracts. Accordingly, the shape memory alloy member 910 is expanded by heat applied by the heater 520, thereby connecting the first connection terminals 901*a* and 901*b* to the second connection terminals 902*a* and 902*b*. As the first connection terminals 901*a* and 901*b* are connected to the second connection terminals 902*a* and 902*b*, a closed loop circuit is formed between the external power source 350 and the superconducting coil 100, thereby able to transfer the electric current between the external power source 350 and the superconducting coil 100.

When the electric current needs to be stopped from being transferred to the superconducting coil 100 from the external power source 350, the controller 600 prevents heat from being applied to the shape memory alloy member 910 by stopping the operation of the heater 520. Accordingly, the heat transferred to the heater 520 is blocked, and the temperature of the shape memory alloy member 910 decreases to a predetermined temperature, and thus the shape memory alloy member 910 is contracted, thereby releasing the connection between the first connection terminals 901*a* and 901*b* and the second connection terminals 902*a* and 902*b*. If the first connection terminals 901*a* and 901*b* are connected to the second connection terminals 902*a* and 902*b*, a closed loop circuit is not formed between the external power source 350 and the superconducting coil 100, thereby stopping the supply of electric current.

Meanwhile, the description of the embodiment illustrated on the FIGS. 9 and 10 has been made in relation that the shape memory alloy member 910 is coupled to the second connection terminals 902*a* and 902*b*. However, according to another exemplary embodiment, the shape memory alloy member 910 may be coupled to the first connection terminals 901*a* and 901*b*.

While exemplary embodiments have been particularly shown and described above, it would be appreciated by those skilled in the art that various changes may be made therein without departing from the principles and spirit of the present inventive concept as defined by the following claims.

What is claimed is:

1. A superconducting magnet apparatus comprising:

a superconducting coil which generates a magnetic field when an electric current from an external power source is applied thereto; and a switch which selectively connects the external power source to the superconducting coil, wherein the switch comprises:

a bellows;

a first fixed terminal and a second fixed terminal electrically connected to only one of the external power source and the superconducting coil; and a first movable terminal and a second movable terminal electrically connected to only the other of the superconducting coil and the external power source and moving according to expansion and contraction of the bellows, and wherein the first movable terminal is connected to the first fixed terminal and the second movable terminal is connected to the second fixed terminal according to the expansion or contraction of the bellows.

2. The superconducting magnet apparatus of claim 1, wherein the switch comprises a bellows-type switch which is set to an on state and an off state by expansion and contraction of the bellows.

3. The superconducting magnet apparatus of claim 2, wherein the bellows-type switch comprises the bellows which expands or contracts according to an internal pressure, at least one switch which switches to the on or off state according to the expansion or contraction of the bellows, a gas tank which supplies the bellows with gas, a gas supply pipe which provides a path for the gas supplied from the gas tank to the bellows, and a gas vent pipe which provides a path for the gas discharged from the bellows.

4. The superconducting magnet apparatus of claim 3, wherein the first and second fixed terminals are electrically connected to the external power source and the first and second movable terminals are electrically connected to the superconducting coil.

5. The superconducting magnet apparatus of claim 4, wherein when the bellows is expanded, the fixed terminals electrically connected to the external power source are connected to the movable terminals electrically connected to the superconducting coil, the external power source supplying current to the superconducting coil.

6. The superconducting magnet apparatus of claim 4, wherein when the bellows is contracted, the fixed terminals electrically connected to the external power source are disconnected from the movable terminals electrically connected to the superconducting coil to cease supply of current to the superconducting coil.

7. The superconducting magnet apparatus of claim 2, wherein the bellows-type switch comprises the bellows that expands or contracts according to an internal pressure, at least one switch that is switched according to the expansion or contraction of the bellows, a gas transfer pipe which supplies an inner side of the bellows with gas or discharge gas from the bellows, a gas tank which stores the gas that is supplied to the bellows or discharged from the bellows, a heater which heats the gas tank and a heat sink which connects to the bellows and dissipates heat.

8. The superconducting magnet apparatus of claim 7, wherein the heater is turned on to increase a temperature of the stored gas in the gas tank, thereby supplying the gas stored in the gas tank to the bellows, and the heater is turned off to decrease the temperature of the stored gas in the gas tank, thereby discharging the gas in the bellows to the gas tank.

9. The superconducting magnet apparatus of claim 1, wherein the switch comprises a shape memory alloy (SMA)-type switch which is set to an on state and an off state according to a temperature.

10. The superconducting magnet apparatus of claim 9, wherein the SMA-type switch comprises a first connection terminal which connects to the external power, a second connection terminal which connects to the superconducting coil, a shape memory alloy member which couples to one of the first connection terminal and the second connection terminal, and a heater which applies heat to the shape memory alloy member.

11. The superconducting magnet apparatus of claim 10, wherein the shape memory alloy member remembers shapes that correspond to different temperatures.

12. The superconducting magnet apparatus of claim 11, wherein the shape memory alloy member is a two-way shape memory alloy member which remembers shapes that correspond to two temperatures.

13. The superconducting magnet apparatus of claim 10, wherein if a heat is applied to the shape memory alloy member by the heater, the shape memory alloy member reaches to a predetermined temperature and expands, and if the shape memory alloy expands, the first connection terminal is connected to the second connection terminal.

14. The superconducting magnet apparatus of claim 10, wherein if a heat is not applied to the shape memory alloy member by the heater, the temperature of the shape memory alloy member cools to a room temperature or maintains a room temperature and contracts, and if the shape memory alloy contracts, the first connection terminal disconnects from the second connection terminal or remains disconnected from the second connection terminal.

15. A method of controlling a superconducting magnet apparatus, the method comprising:

providing a superconducting coil which generates a magnetic field when an electric current from an external power source is applied thereto, wherein the superconducting magnet apparatus comprises a switch which selectively connects the external power source to the superconducting coil and comprises:

a bellows;

a first fixed terminal and a second fixed terminal electrically connected to only one of the external power source and the superconducting coil; and a first movable terminal and a second movable terminal electrically connected to only the other of the superconducting coil and the external power source and moving according to expansion and contraction of the bellows, and wherein the first movable terminal is connected to the first fixed terminal and the second movable terminal is connected to the second fixed terminal according to the expansion or contraction of the bellows;

supplying an electric current to the superconducting magnet apparatus from the external power source by switching on the switch, and shutting off the electric current to the superconducting magnet apparatus from the external power source by switching off the switch.

16. The method of claim 15, wherein the switch is a bellows-type switch which is set to an on state or an off state by expansion and contraction of the bellows.

17. The method of claim 15, wherein the switch comprises a shape memory alloy (SMA)-type switch which is set to an on state and an off state adjustable according to a temperature.

18. A switch which selectively connects an external power source to a superconducting coil of a superconducting magnet apparatus, the switch comprising:

a bellows;

a first fixed terminal and a second fixed terminal electrically connected to the external power source;

a first movable terminal and a second movable terminal electrically connected to the super conducting coil;

a first support member and a second support member; and a first elastic member and a second elastic member, wherein the first fixed terminal is fixed to the first support member and the first movable terminal is coupled to the first elastic member and moves according to expansion and contraction of the bellows, and wherein the second fixed terminal is fixed to the second support member and the second movable terminal is coupled to the second elastic member and moves according to expansion and contraction of the bellows.

19. The switch of claim 18, wherein if the bellows expands, the first movable terminal make a contact with the first fixed terminal and the second movable terminal make a contact with the second fixed terminal, and wherein if the bellows contracts, the first movable terminal disconnects from the first fixed terminal by a tension of the first elastic member and the second movable terminal disconnects from the second fixed terminal by a tension of the second elastic member.

20. A superconducting magnet apparatus comprising:

a superconducting coil which generates a magnetic field when an electric current from an external power source is applied thereto; and a switch which selectively connects the external power source to the superconducting coil, wherein the switch comprises:

a bellows;

a first fixed terminal and a second fixed terminal electrically connected to one of the external power source and the superconducting coil; and a first movable terminal and a second movable terminal electrically connected to the other of the super conducting coil and the external power source and moving according to expansion and contraction of the bellows, wherein the second movable terminal is discrete from the first movable terminal.

21. A method of controlling a superconducting magnet apparatus, the method comprising:

providing a superconducting coil which generates a magnetic field when an electric current from an external power source is applied thereto, wherein the superconducting magnet apparatus comprises a switch which selectively connects the external power source to the superconducting coil, and the switch comprises:

a bellows;

a first fixed terminal and a second fixed terminal electrically connected to the external power source or the superconducting coil;

a first movable terminal and a second movable terminal electrically connected to the super conducting coil or the external power source and moving according to expansion and contraction of the bellows, wherein the second movable terminal is discrete from the first movable terminal;

supplying an electric current to the superconducting magnet apparatus from the external power source by switching on the switch, and shutting off the electric current to the superconducting magnet apparatus from the external power source by switching off the switch.

* * * * *